United States Patent [19]

Faulstich

[11] 4,302,924

[45] Dec. 1, 1981

[54] WIRE STRANDING APPARATUS

[75] Inventor: Gerhard H. Faulstich, Spartanburg, S.C.

[73] Assignee: International Wire Products Company, a Division of Carlisle Corporation, Wyckoff, N.J.

[21] Appl. No.: 96,140

[22] Filed: Nov. 20, 1979

[51] Int. Cl.[3] ..... D07B 3/12; D01H 7/86

[52] U.S. Cl. ..... 57/58.52; 57/68.63; 57/58.83; 57/115; 57/138

[58] Field of Search ..... 57/58.3, 58.32, 58.49, 57/58.52, 58.72, 58.81, 58.83, 266, 115, 138

[56] References Cited

U.S. PATENT DOCUMENTS

| | | | |
|---|---|---|---|
| 1,516,900 | 11/1924 | Wright et al. | 57/58.81 X |
| 3,791,127 | 2/1974 | Wesson | 57/58.52 |
| 3,867,809 | 2/1975 | Holbrook | 57/58.52 |
| 4,072,003 | 2/1978 | Mino | 57/58.52 |

FOREIGN PATENT DOCUMENTS

| | | | |
|---|---|---|---|
| 1085134 | 9/1967 | United Kingdom | 57/58.52 |

*Primary Examiner*—Donald Watkins
*Attorney, Agent, or Firm*—William G. Rhines

[57] ABSTRACT

This invention relates to apparatus for making stranded wire, and in one embodiment comprises a lightweight frame with low centripetal and friction force generating characteristics for receiving individual wires from spools mounted on a "floating" bed, and imparting twist to them prior to the finished strand being accumulated on a take-up reel. Other embodiments may include a wire stranding machine wherein a spool tray for holding spools of wire to be stranded is removeable mounted at each end to the interior of a twisting frame by means of bearings such that the twisting frame may revolve about and relative to the tray.

4 Claims, 12 Drawing Figures

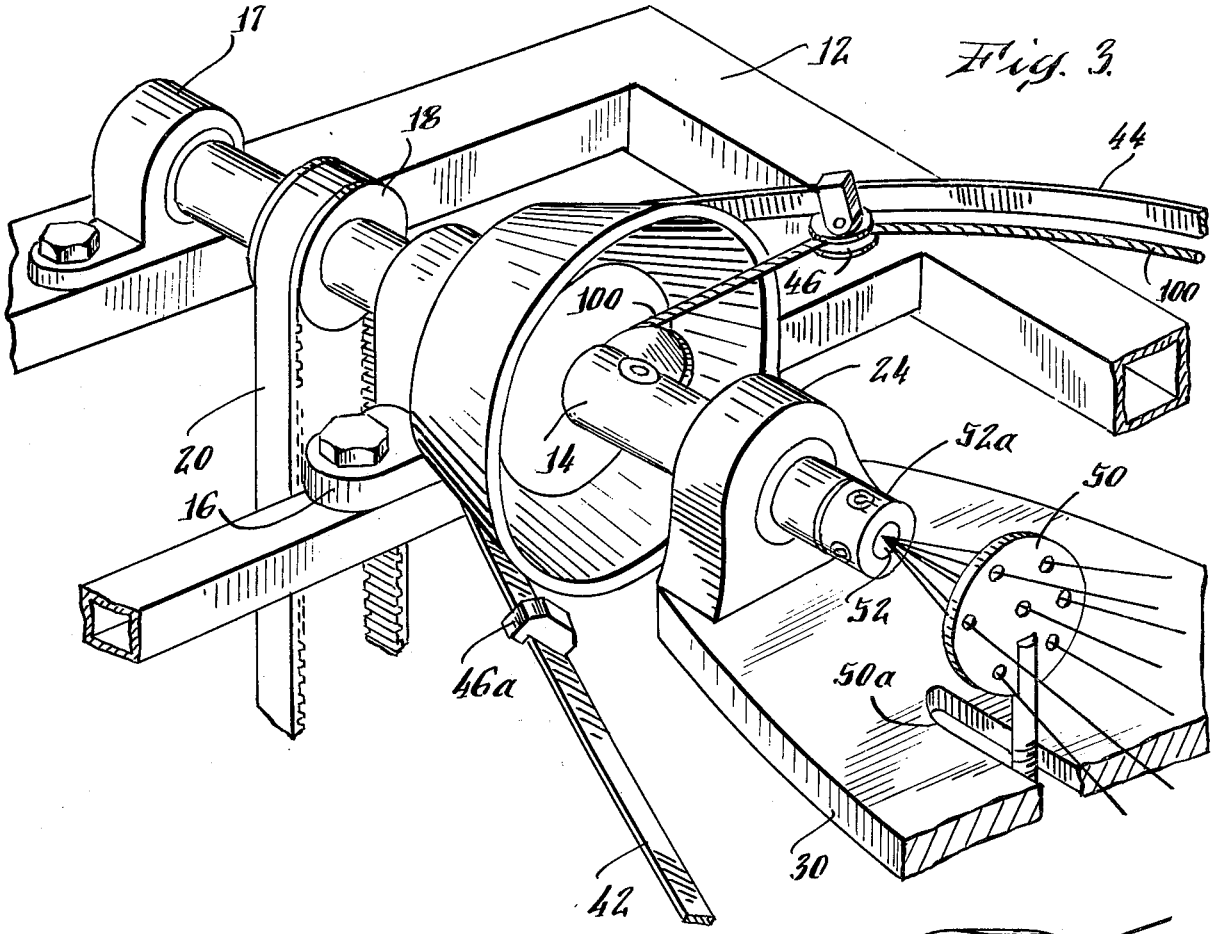
Fig. 3.
Fig. 4.
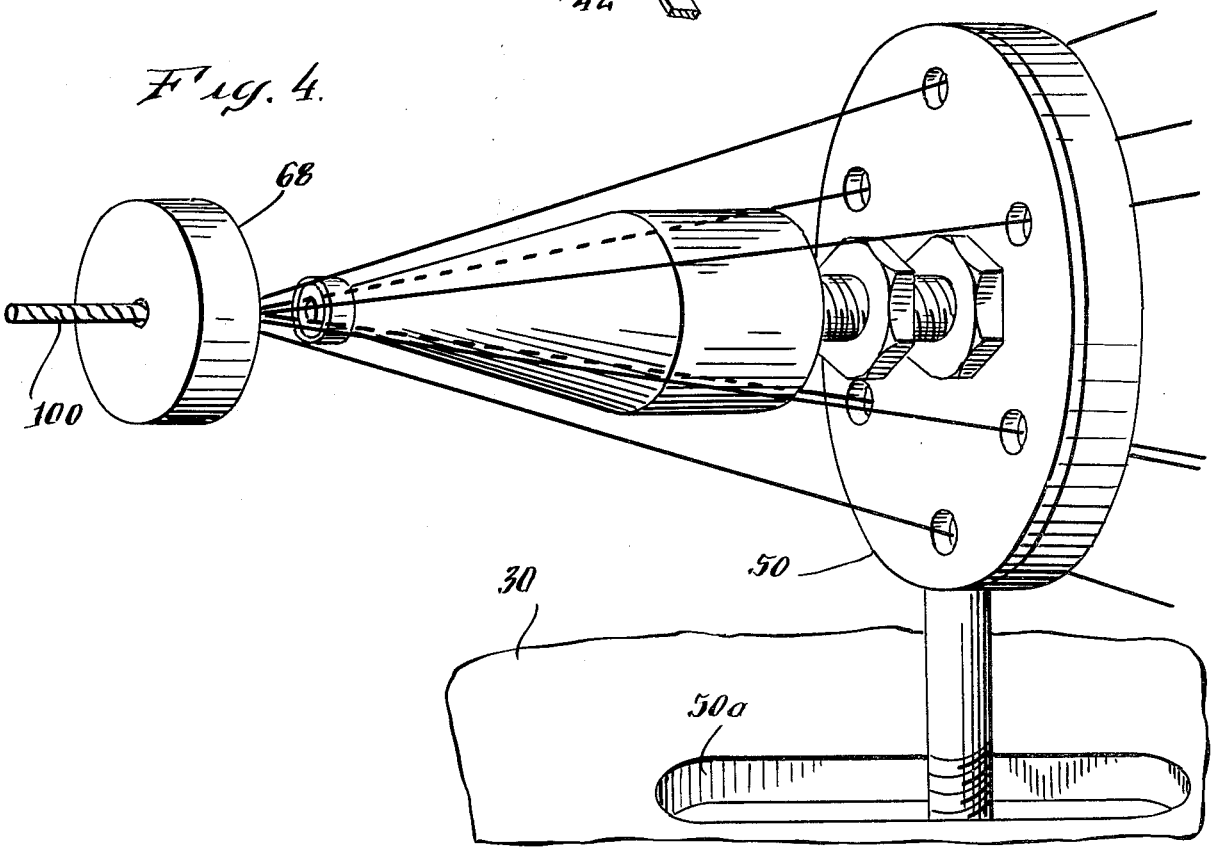

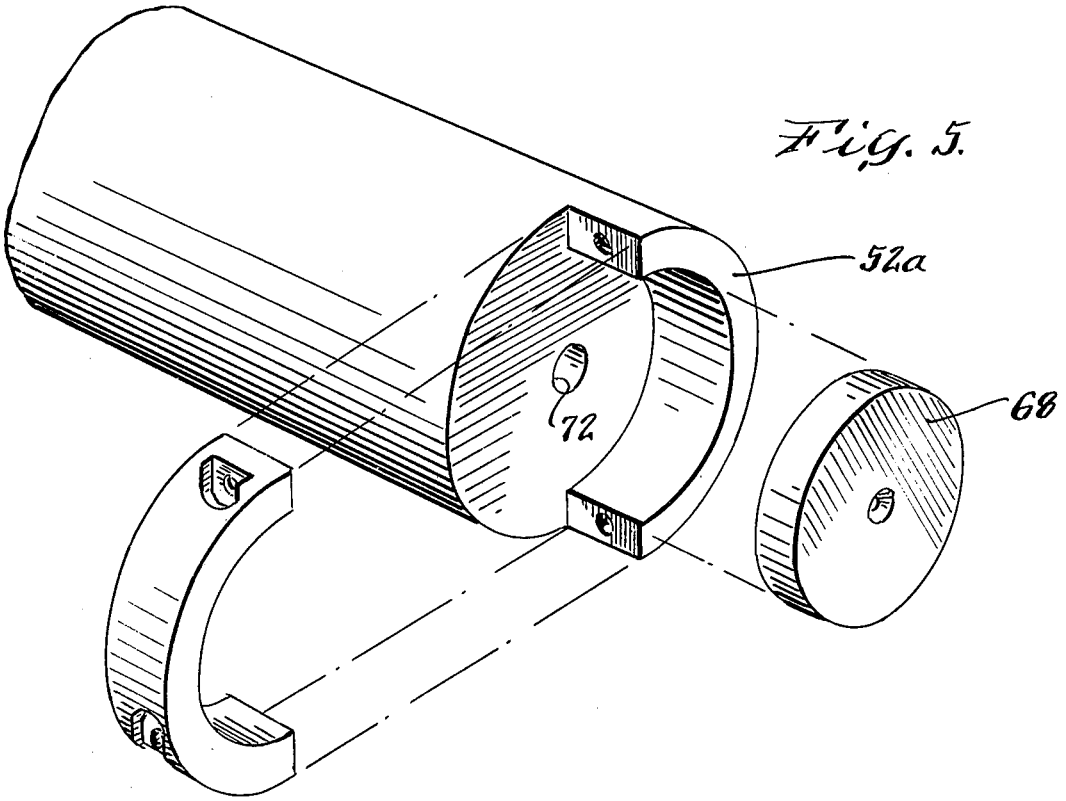
Fig. 5.
Fig. 6.
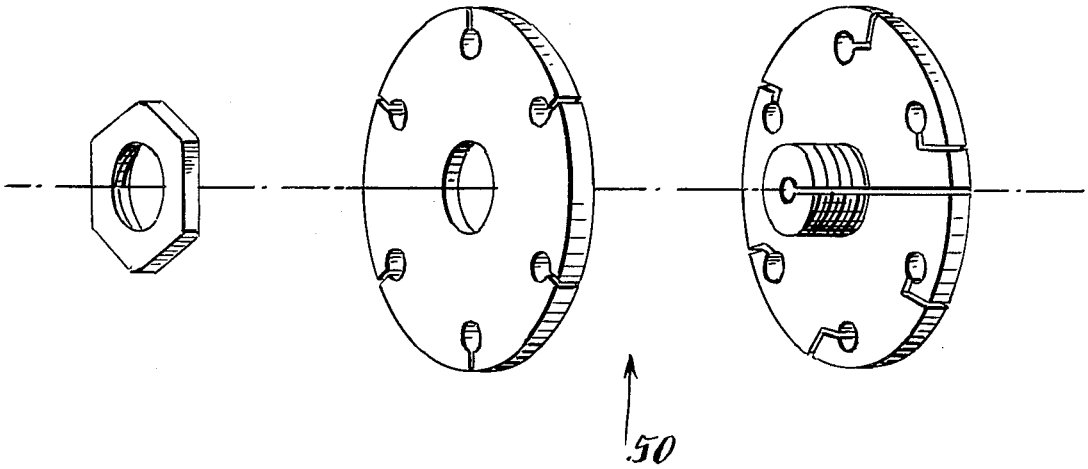

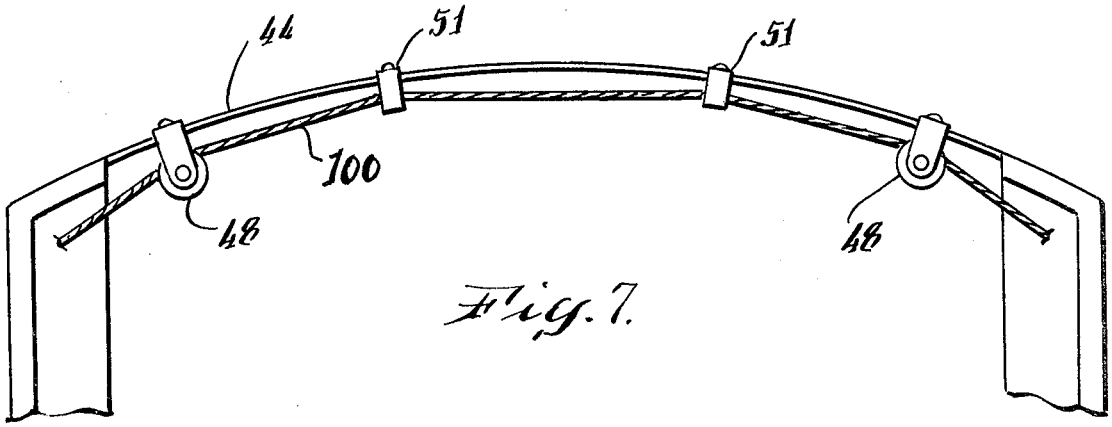
Fig. 7.
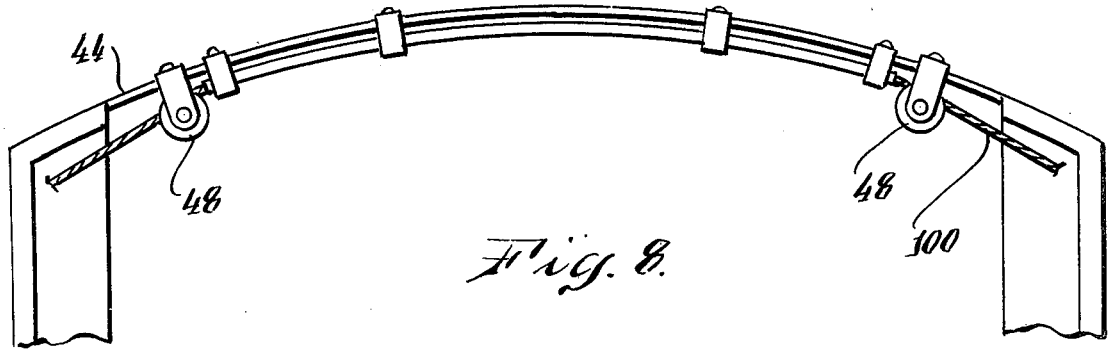
Fig. 8.
Fig. 12.
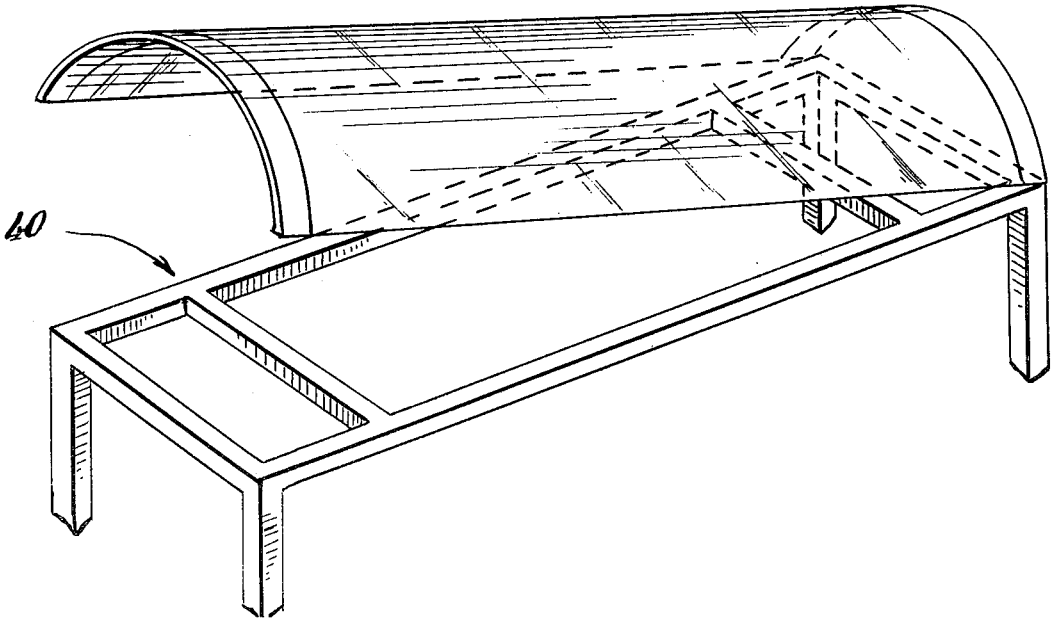

WIRE STRANDING APPARATUS

BACKGROUND OF THE INVENTION

A wide variety of machinery is available for making stranded wire, for example, of the type which subsequently is insulated for use in electrical installations. Such operations have been performed in the past on machines in which the spools of wire were rotated about a central core wire to produce a so-called concentric strand configuration. By a "concentric" strand is meant one wherein the strands of each successive layer surround the core wire rest side-by-side, and have some back-twist to reduce the tendency of the constituent wire to open up. The mechanical and dynamic problems inherent in such machines include high centrifugal forces and high friction forces, which must be accomodated by reduced operating speeds, reinforced structures, and complex structures. Additionally, the finished product tends to be difficult to control as to surface condition, and uniformity of size and weight. Such considerations have led to the use of other means to produce stranded wire. For example, so-called bunchers, particularly of the "reverse twist" type, have been modified to guide the constituent wires into the geometric configuration of a concentric strand, rather than the comparatively random configuration of a bunch strand. Typically, however, the products of such operations exhibit characteristics which are deemed undesirable in the industry. For example, unidirectional lay of successive layers of wires, insufficient back-twist in the individual strands to ensure dynamic retention of the constituent wires in place, and damage to the constituent wires caused by the dies that are used to effect closure of the wires and monitoring of the overall diameter of the finished strand, are objectionable results of such processes. These are among the reasons for the better alternative having been sought in apparatus such as the so-called "barrel strander". In such machines, a row of spools containing single-end wire, alone or in combination with a previously stranded core where a multi-layered strand is to be produced, are gimble-mounted on support bearings along the central axis of an apertured outer cylinder, so that the latter may revolve about them while they remain relatively stationary. The wires may then be paid off from the spools through pulleys arrayed on the inside of of the cylinder, through a closure die to a take-up reel for the finished strand. However, in order to achieve the high barrel rotation speeds which are a necessary concomitant of the high production rates which are desired, it is necessary to minimize as far as possible the weight and diameter of the barrel, so that centrifugal forces will be minimized as well. Correspondingly, this presents engineering problems in accomodating spools of individual size such that comparatively long strands may be produced, and in mounting them in tandem down the length of the axis of the interior of the barrel. The result is that machinery of this type does not lend itself to the production of materials which are susceptible to deformation as a consequence of the resulting torsional and friction forces, such as finer strands made from malleable material such as copper, since the quality, size, weight, surface, and electrical variations which result are not up to standards desired by industry. Further, in the use of stranders of the barrel type, when an individual spool of wire runs out, it is the industry practice to connect the end of the wire on the spent spool to the beginning of the wire on a replacement spool. This is done by silver-soldering the two together or utilizing other connection means, which are tedious and time-consuming to perform. The structural configuration, and size limitations of such machines render alternative procedures impractical.

Accordingly, it is an object of this invention to provide means which will produce a concentric configuration of wire strands.

Another object of the present invention is to provide such means to minimize weight, diameter, resistivity, and surface variations in the production of articles made from comparatively soft materials.

Still another object is to provide stranding means in which changeovers in direction and/or lay-length may be easily changed.

Another object is to produce such means which are easier to load than prior art stranding machines.

Yet another object is to satisfy the foregoing objectives with means which have low weight and simple construction, to minimize centrifugal and other dynamic forces when the machine is in operation and to facilitate access to its various constituent parts for its operation and maintenance.

SUMMARY OF INVENTION

Desired objectives may be achieved through practice of the present invention, embodiments of which include a support cradle for holding a multiplicity of spools of wire mounted to a support frame by bearing means which permit the cradle to remain positionally stable while a closure die and an associated frame spin with the frame rotating about the cradle, the cradle and its associated spools being replaceable in the machine as a unit.

DESCRIPTION OF DRAWINGS

This invention may be understood from the description which follows, and from the appended drawings in which:

FIG. 3 is a perspective view of the front portion of the embodiment of this invention shown in FIGS. 1 and 2, FIG. 4 is a perspective view of the forming place-forming cone-closure die assembly useful with embodiments of this invention, FIG. 5 is an exploded perspective view of the drive shaft-closure die assembly useful with embodiments of this invention, FIG. 6 is an exploded perspective view of a closure plate assembly useful with embodiments of this invention, FIG. 7 illustrates a finished strand guide assembly useful with embodiments of this invention, FIG. 8 illustrates another finished strand guide assembly useful with embodiments of this invention.

FIG. 12 is a perspective view of a hood assembly useful with embodiments of this invention.

DESCRIPTION OF PREFERRED EMBODIMENTS

Figure 1:
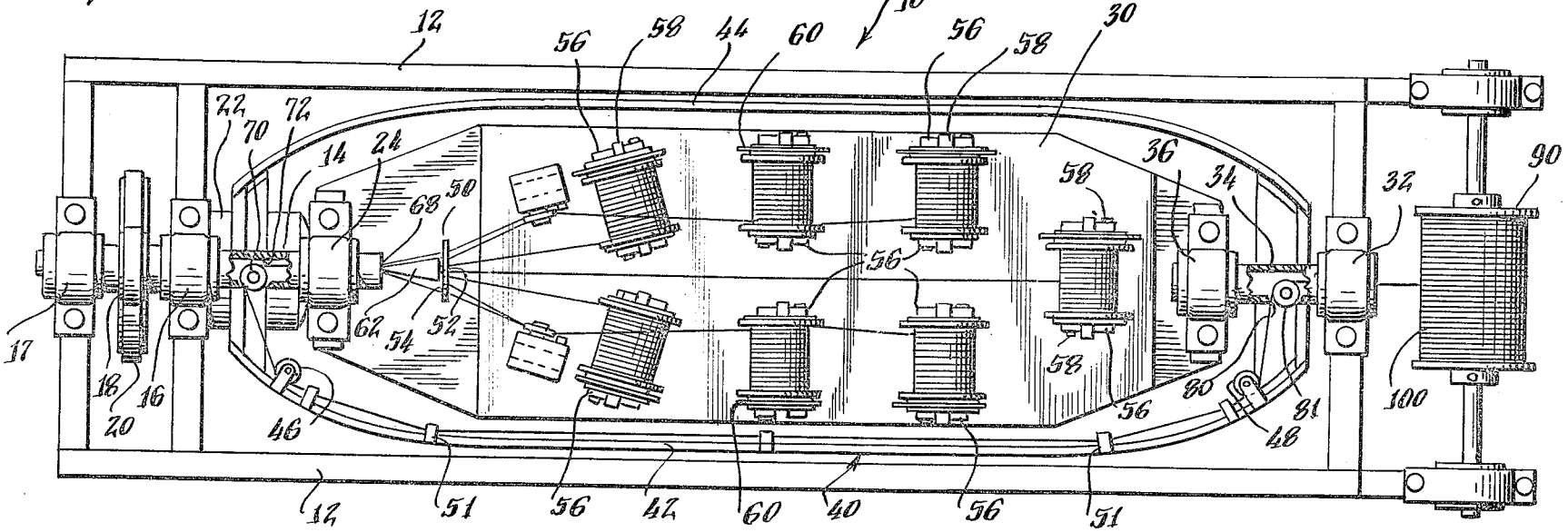
FIG. 1 is a top plan view of an embodiment of this invention.

Referring first to FIG. 1, there is depicted an embodiment of the present invention in the form of a 7-wire concentric stranding machine 10. It will be clear from what follows that the principles of this invention are applicable to other strand configurations as well, such as 19 wire strands (1-6-12), 49 wire strands (7×7), etc. The embodiment shown in FIG. 1 includes a support frame 12 to which a drive shaft 14 is rotatably affixed by means of bearing blocks 16, 17. To the outer end of the shaft 14 is affixed a pulley 18 which may be rotated by a belt 20 driven by a motor 22. About the innermost end of the shaft 14 is rotatably affixed a cradle bearing 24, preferably of the split bearing type, so-called, to facilitate replacement of the cradle 30 as hereinafter described; the outer casing of the lower portion of the bearing 24 being affixed to one end of the cradle 30. There is a similar arrangement at the opposite end of the machine where a shaft bearing 32 supports a cradle shaft 34, from the innermost end of which the cradle 30 is moveably supported by means of a cradle bearing 36, also preferably of the split bearing type to facilitate replacement of the cradle 30. Drive means, comparable to the combination of pulley 18, belt 20, and motor 22 previously described, need not be included at this end of the machine, because as will be apparent from what follows, the single drive means normally will suffice to operate the machine, although optionally such a second drive means might also be included if desired.

Affixed to the shafts 14, 34, intermediate the locations along their lengths at which are positioned respectively the bearings 12, 24 and 32, is a spinning frame or bow 40, consisting of two, generally U-shaped arms 42, 44. At least one of the arms has pulleys 46, 48 and eyelets or guides 51 to serve as guides for wire coming from the machine. These elements are shown in greater detail in FIG. 7. FIG. 8 illustrates an alternate arrangement wherein the strand 100 is carried along the arm 44 by thin-walled plastic or metal tubing 47, which is held in place by tube holders 49. Because of the rigid affixation of the frame arms 42, 44, of the frame 40 to the shafts 14, 34, and the generally U-shaped configuration of the frame arms 42, 44, with the depth of the upright portions of each "U" greater than the width of the cradle 30, as the shaft 14 is driven by the motor 22 via the belt 20 and the pulley 18, the frame 40 will be caused to rotate about the cradle 30. The latter, being mounted to the ends of the shafts 14, 34 by means of the bearings 24, 36, will remain positionally stable without rotating along with the frame 40. It will also be noted that since the direction of frame rotation is a function of the direction in which the motor 22 turns, it is possible simply to reverse the direction of lay of the finished strand merely by reversing the motor.

Toward the front end of the cradle 30, in an adjustment slot **50*a*, there is affixed a closure plate 50. As shown in greater detail in FIGS. 2 and 3, the closure plate 50 includes, in the form illustrated for use in producing a 7-wire strand, a central hole 52, and six evenly spaced peripheral holes 54. Affixed along the top of the cradle 30 are spool supports 56, each having a shaft 58 to rotatably support an associated spool of wire. Optionally, the spool supports 56 may be fitted with friction brakes 60 to ensure that the spools do not run so freely as to permit the wires to become slack and entangle. The spool supports, as shown in this particular configuration, are arrayed so that the two spools closest to the closure plate 50 face inward slightly to better align the wires on them toward the closure plate, and so that one of the spools, the one farthest from the closure plate 50, can pay off between the two rows formed by the remaining six spools of wire and feed its wire into the center hole 52**.

Figure 2:
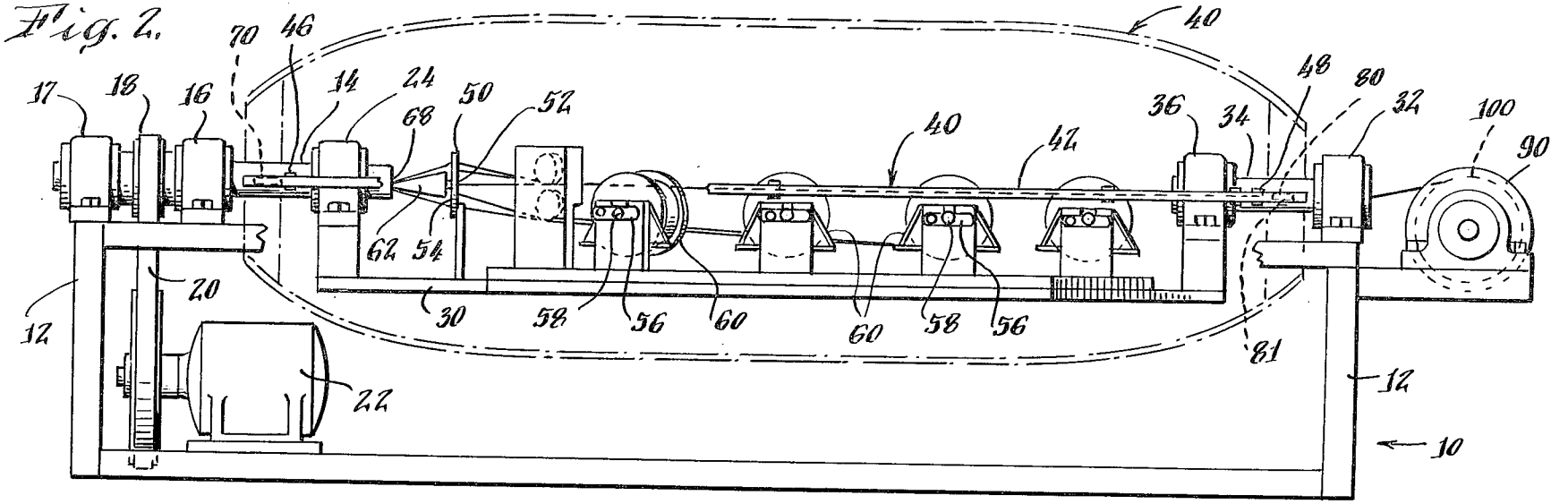
FIG. 2 is a side elevation view of the embodiment of this invention.

In operation, spools of wire are mounted on the cradle 30 as shown in FIGS. 1 and 2, with the wire from each spool fed through one of the holes in the closure plate 50. Those from the front six spools are fed through the peripheral holes 54 and that from the single spool farthest from the closure plate 50 is fed through the central hole 52. By this means it is assured that six peripheral wires will overlay a central wire in abutting relationship, in the proper geometric configuration for a true concentric 7-wire strand. Alternative strand configurations (e.g., a 19-wire concentric strand) would utilize corresponding changes in the hold configuration of the closure plate. The center of the shaft 14 has an axial passageway 72 which preferably may be capped, at the closure plate end, by a forming die 68 which serves the purposes of monitoring the overall diameter of the finished strand. At the other end of the passageway 72 a pulley 70 projects through the side of the shaft 14. This arrangement of elements is shown in greater detail in FIG. 3, and in FIG. 5 which illustrates a means by which the closure die 68 may be removeably affixed to the cradle end of the shaft 14. Optionally, as shown in FIG. 4, there may be positioned between the forming plate 50 and the closure die 68 a forming cone 62 at the closure die end of which is a carbide ring 64 to provide a contact surface for the constituent wires of the strand. The forming cone 62 may be affixed to the closure plate 50 by means of a nut and bolt assembly 67, by operation of which the cone can be adjusted positionally with respect to the closure die 68, so as to better monitor and control the positioning of the strand wires as the strand is being made. Further, as shown in FIG. 6, the forming plate may optionally be made in the form of a base plate **50*a*, with a threaded core member 53 surrounding the central hole 52, over which a supplementary piece 50*b* of the base plate may be positioned and secured by means of a nut 55. It should be noted that there are slots 54*a* associated with each of the holes 54 in plate 50*a*, and slots 54*b* associated with each of the holes 54 in the supplementary piece 50*b*, and that the slots 54*a* will not be congruent with the slots 54*b* when the plate 50*a* and supplementary plate 50*b* are juxtaposed. It should also be noted that the slot 52*a* associated with hole 52 will be covered in the region of the threaded member 53 when the nut 55 is in place. Thus, by this means, it is possible to insert replacement wires through the plate 50** without having to thread them through the plate holes, with assurance that they will not thereafter move out of the holes.

Figure 9:
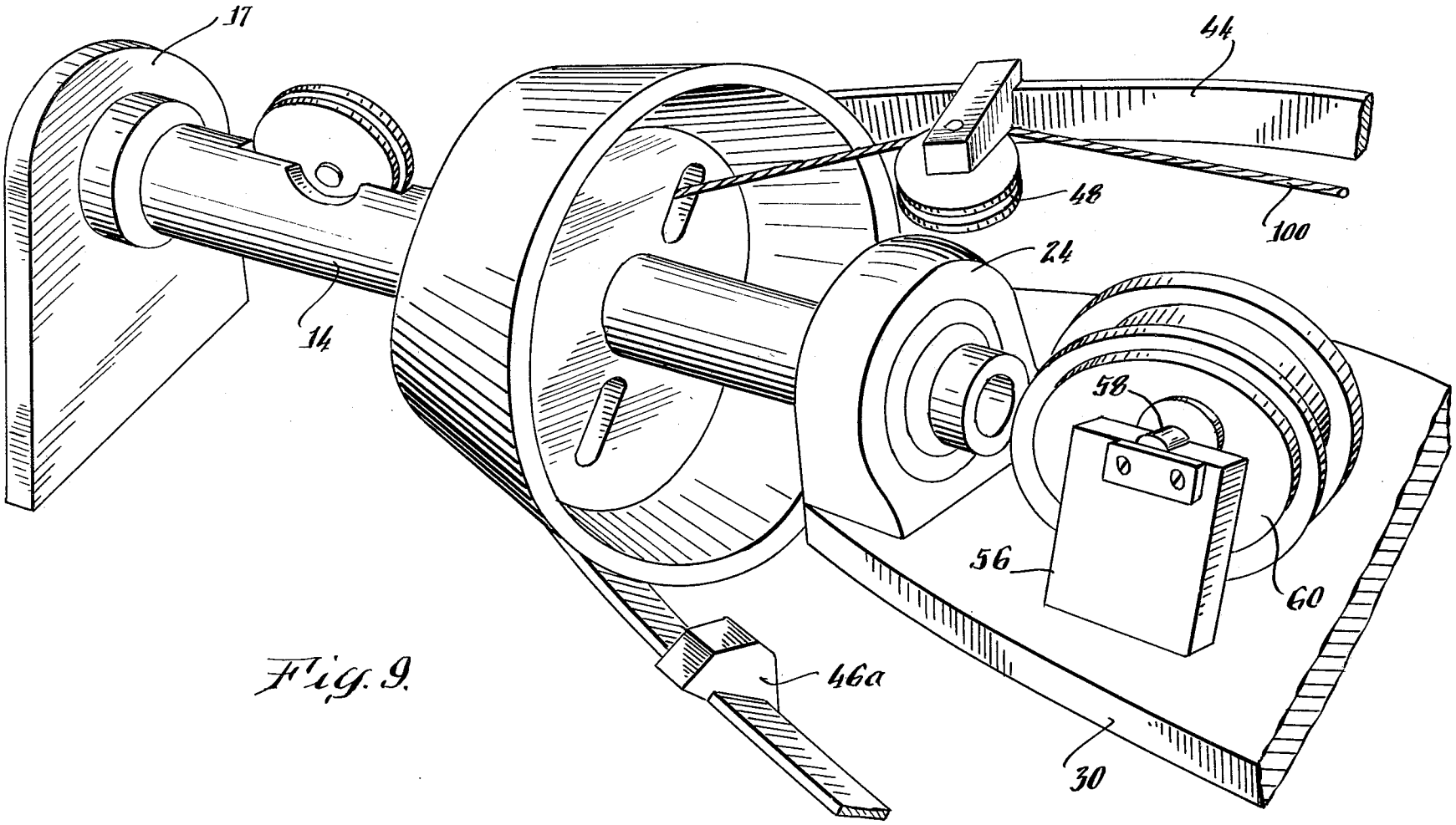
FIG. 9 is a perspective view of the rear portion of the embodiment of this invention shown in FIGS. 1 and 2.

In operation, the seven ends of wire coming from the spool may, as previously noted, be passed through the holes of the closure plate 50 to form a strand 100, and the strand so formed may then be passed through the closure die 68 into the passageway 74, over the pulley 70, over the pulley 46, through the eyelets 51 or tube 47 (as the case may be), and over the pulley 48, then, as is shown in greater detail in FIG. 9, as well as in FIGS. 1 and 2, into a side hole 80 over a pulley 81 in the shaft 34, through a central axial passageway (not shown) in the shaft 34 and straight out through its outer end onto a takeup reel 90. The latter, according to known per se techniques, may be synchronized so as to take up the finished wire evenly as it comes off of the machine. Thus, as the frame 40 is powered by the motor 22 and caused to revolve about the spool cradle 30, the latter staying relatively stable, the wires are caused to be twisted into a true concentric strand 100 and, having been so twisted, to be given a final twist just before being delivered to the take-up reel 90.

Figure 10:
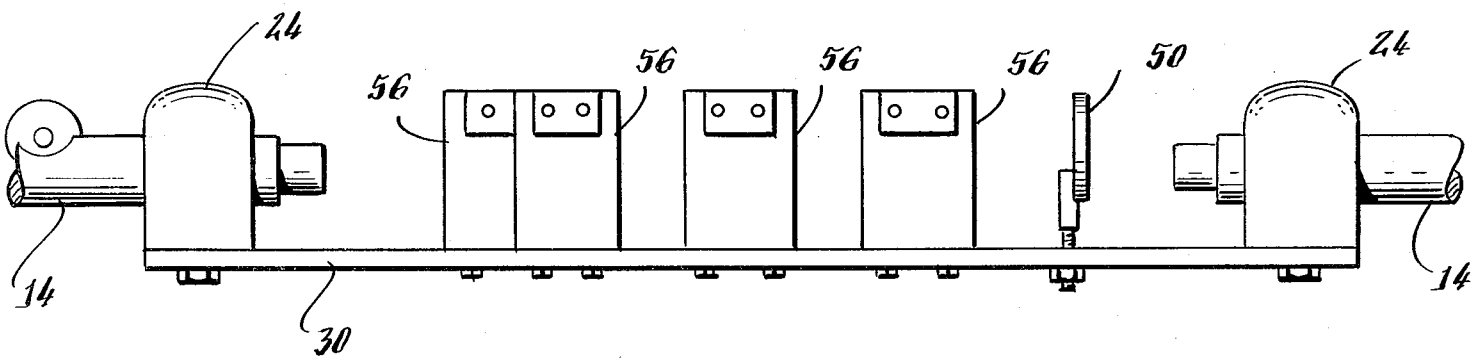
FIG. 10 is a side view of a spool mounting bed assembly useful with embodiments of the present invention.
Figure 11:
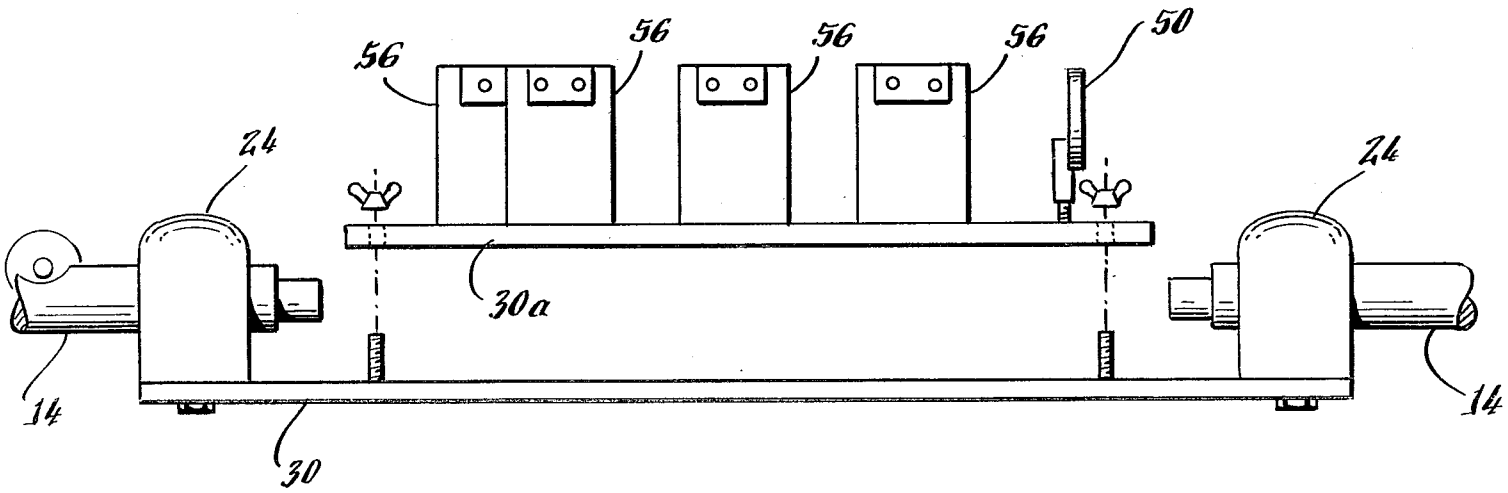
FIG. 11 is a side view of another spool mounting bed assembly useful with embodiments of the present invention.

Upon all or any one of the constituent wires breaking or being exhausted, the machine may be stopped automatically by known per se automatic stop means, or manually. If the cradle is of the type illustrated in FIG. 10, the individual broken wire may be brazed and/or re-threaded, or one or more spools replaced and their respective wires brazed for continuity to their predecessors and/or re-threaded, or, by removing the entire spool cradle 30, as by removal of the top half of the bearings 24, 36 when they are of the known per se split bearing type, the entire cradle 30 may be removed as a unit and replaced by another similar entire unit which includes seven full spools. FIG. 11 illustrates alternative apparatus which may be utilized to achieve the last-mentioned type of changeover without the necessity of having or opening split bearings as noted. In this embodiment, the cradle 30 has associated supplementary cradles 30*a* to which the spool supports 56 and forming plate assembly 50 are affixed. Each such supplementary cradle 30*a* may be affixed to a cradle 30 through operation of threaded studs 200 and associated wing nuts 202 as illustrated. Thus, by this means also the wires from the spools may be connected to the rear ends of the previous set of wires, albeit temporarily, as by merely tying them together, merely to facilitate pulling them through, or by permanently bonding them, end to end, as by soldering, as is known per se. With such "unit changeover" features, distinct advantages are realized. For example, the frequency of machine stoppages may be treatly enhanced through practice of these embodiments of this invention because servicing of the spools and/or wires can take place away from the machine itself, and without the machine being stopped while it takes place.

FIG. 12 illustrates how embodiments of this invention may also include a cover, such as a dome 300 of expanded metal or plexiglass as illustrated, for purposes of noise reduction, safety, and reduction of contamination.

It is to be understood that the embodiments of this invention herein disclosed and illustrated, are by way of illustration, and not of limitation, and that this invention may be carried out in a wide variety of embodiments without departing from the spirit or scope of this invention.

It is also to be understood from the foregoing that embodiments made in accordance with the present invention make it possible to achieve advantages over prior art apparatus for producing stranded wire which, as previously noted, include stranders of the "buncher" and the "barrel" type. With the former, individual wires from spools outside the machine are twisted and are gathered on an interior take up spool. This configuration makes it impossible to check the strand being produced without stopping the machine. A barrel strander, on the other hand, permits such monitoring to take place without stopping the machine, but because the spools of constituent single-end wire are arrayed linearly along the axis of the barrel and must be held substantially stationary while the barrel turns in order to create the desired twist, the spools must be bearing mounted with respect to the barrel. The resulting weight added to the barrel makes it heavy and susceptible to the high dynamic forces, limiting its speed and further necessitating weight being added to the barrel. Thus, through practice of the present invention, it is possible to monitor work product continuously while, at the same time, realizing the advantages of low weight, high speed, structurally simple stranding apparatus.

I claim:

1. Apparatus for stranding wire comprising a support frame, a first shaft bearing means affixed to one end of said frame, and a second shaft bearing means affixed to the end of said frame opposite that at which said first shaft bearing means is located, separate shafts rotatably positioned in each of said shaft bearing means, said shafts being coaxial with each other and including strand passage means, spool cradle support bearing means rotatably affixed to the innermost ends of each of said shafts, a spool cradle, adapted for supporting a plurality of spools thereon with one of said spools positioned with its axis normal to an imaginary flat plane which includes the axes of said shafts while being normal to the plane of said spool cradle and with the remainder of said spools positioned in two linear arrays which are on opposite sides of said imaginary flat plane and substantially equidistantly spaced apart therefrom at corresponding locations between said shafts along said imaginary flat plane, affixed at each of its ends to one of said spool cradle support bearing means, a twisting frame having at least one arm, each end of which is affixed to one of said shafts between said frame and said cradle, which arm includes strand guide means and is so dimensioned and configured as to pass between said frame and said cradle as it moves upon rotation of shafts, and finished strand take-up means, whereby wires may pass from spools supported by said cradle into the strand passage means of one of said shafts and, as said frame rotates while said cradle remains unrotating, be twisted into a strand, passed along said guide means from one end to the other end of said arm, passed through the strand passage means in the other of said shafts, further twisted, and taken up through operation of said take-up means.

2. The apparatus described in claim 1 adapted for simultaneous removal of all of said spools by the portion of said cradle including the surface which said spools are supported being removeable as a unit.

3. The apparatus described in claim 2 wherein said portion comprises a member removeably affixed to a corresponding bed member of said cradle.

4. The apparatus described in claim 1, 2, or 3 including a guide plate affixed to said cradle whereby wires being paid off from said spools may be juxtaposed in a desired configuration prior to passing to said frame.

* * * * *